United States Patent [19]

Welch, Jr.

[11] 4,159,580

[45] Jul. 3, 1979

[54] GRAIN DRYING BIN

[76] Inventor: Richard Welch, Jr., 2016 W. Division, Grand Island, Nebr. 68801

[21] Appl. No.: 854,599

[22] Filed: Nov. 25, 1977

[51] Int. Cl.[2] ..... F26B 17/12

[52] U.S. Cl. ..... 34/168; 34/174; 34/181; 52/82

[58] Field of Search ..... 34/218, 165, 166, 174, 34/179, 168, 181; 52/82, 192, 194, 197

[56] References Cited

U.S. PATENT DOCUMENTS

| | | | |
|---|---|---|---|
| 534,030 | 2/1895 | Caine | 34/174 |
| 914,598 | 3/1909 | Morsey-Picard et al. | 34/174 X |
| 2,228,609 | 1/1941 | Ragui | 52/197 X |
| 3,775,863 | 12/1973 | Updegrove | 34/166 |
| 3,782,004 | 1/1974 | Black | 34/174 |
| 3,869,809 | 3/1975 | Keirn | 34/174 |

FOREIGN PATENT DOCUMENTS

| | | | |
|---|---|---|---|
| 1951641 | 3/1972 | Fed. Rep. of Germany | 34/174 |

*Primary Examiner*—Andrew V. Kundrat

*Attorney, Agent, or Firm*—Hill, Van Santen, Steadman, Chiara & Simpson

[57] ABSTRACT

A grain drying bin is disclosed having a simplified structural supporting system and which provides rapid drying of stored grains. An upper truncated pyramidal shaped housing section has at least three inwardly sloping planar side walls and a horizontal roof portion with a grain entry port. A lower inverted truncated pyramidal shaped housing section having the same number of planar inwardly sloping side walls is provided. The two housing sections directly join to one another with the lower housing section being substantially supported in a cavity in the ground. Ventilation panels are mounted substantially parallel to and at a predetermined spacing from the side walls and floor portion of the lower housing section. A hot gas inlet aperture is provided to permit the entry of heated gas into the spaces between the side walls and the ventilation panels.

5 Claims, 7 Drawing Figures

Fig. 1
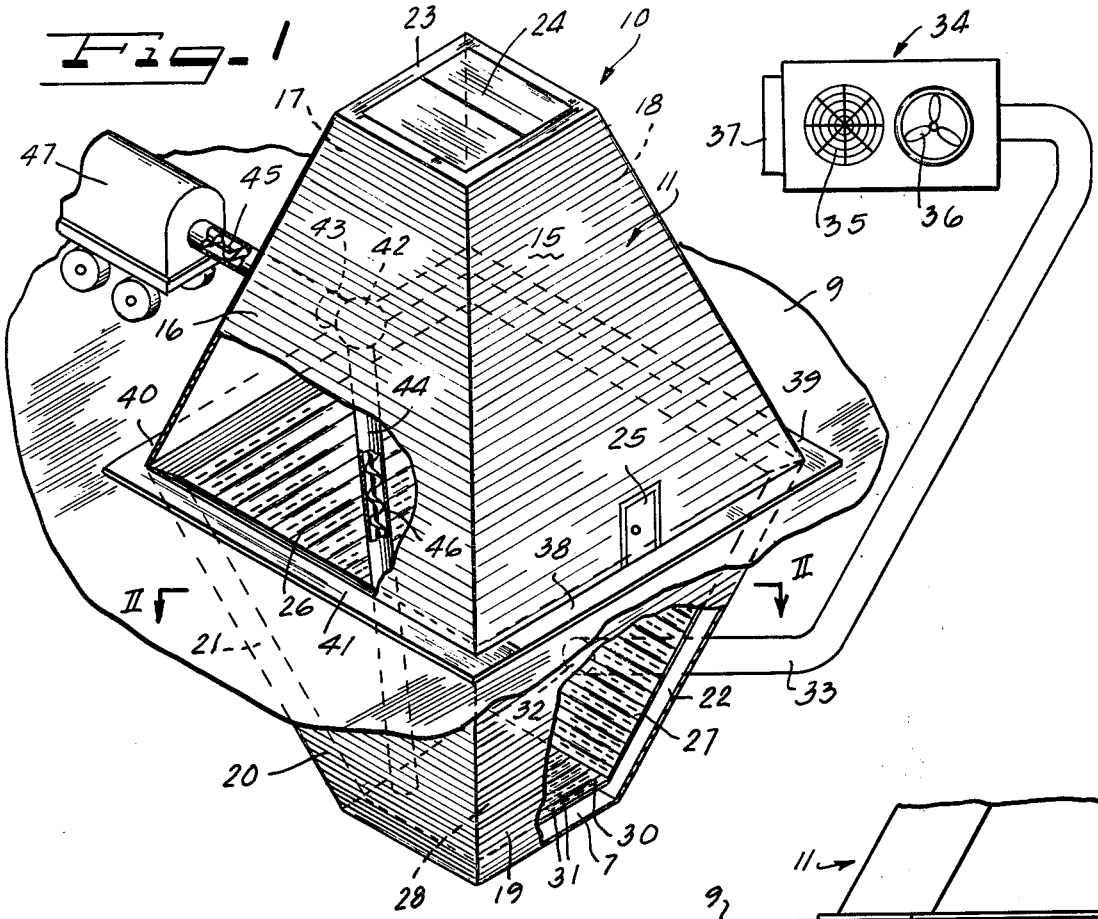
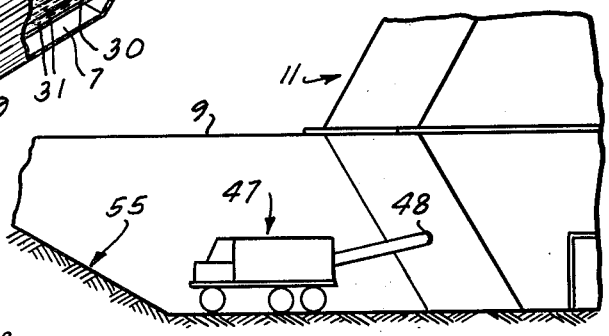
Fig. 2
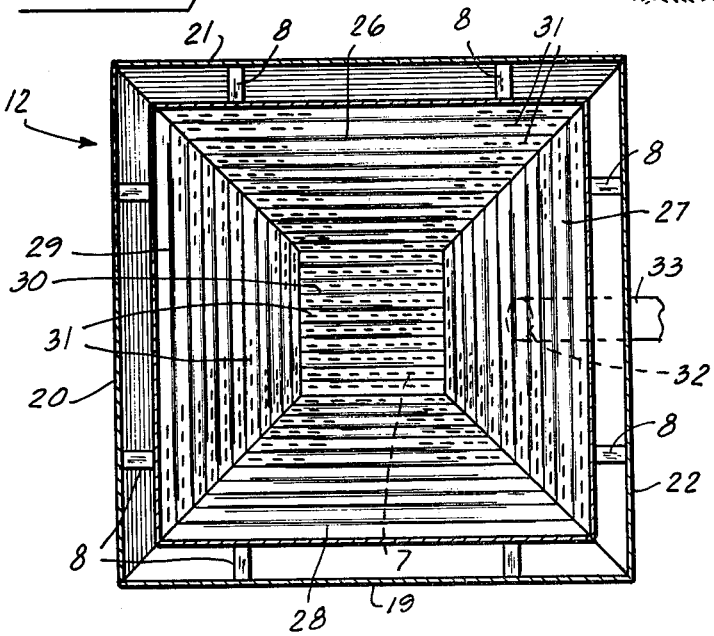
Fig. 3

GRAIN DRYING BIN

BACKGROUND OF THE INVENTION

1. Field of the Invention

This invention relates to grain drying bins and more particularly to grain drying bins utilizing heated air for drying of the grain.

2. Description of the Prior Art

Grain drying bins are known wherein heated air is channeled through a floor portion of the bin so as to rise upwardly through the grain stored therein. With such systems, a majority of the grain is stored in portions of the housing which is substantially cylindrical over a given elevational distance. Consequently, the air which is injected through the floor portion must travel upwardly through large quantities of grain before reaching levels having damp grain at the top. Consequently, the drying procedure is time consuming and requires a substantial amount of energy for heating the drying gas.

It is also known to provide grain drying bins which are substantially above ground and consequently require complicated structural configurations for supporting the grain bins.

Finally, in grain bins having a substantially cylindrical overall shape with a floor portion of approximately the same cross-section as upper portions of the bin, it is difficult to unload the grain from the bin in areas at the bottom since the grain tends to become trapped along the periphery of the floor, an area which is not conveniently accessible with the known types of unloading devices such as auger implements.

SUMMARY OF THE INVENTION

It is an object of this invention to provide a grain drying bin which is simple in construction and does not require complicated structural configurations.

It is another object of this invention to provide a grain storage bin in which the overall quantity of grain directly exposed to the drying gas is increased to promote faster drying.

It is further object of this invention to provide a grain drying bin in which unloading of the bin is simplified and all portions of the bin, particularly near the floor, are accessible by unloading apparatus such as an auger.

According to the invention, a grain drying bin for the rapid drying of stored grains has an upper housing section having inwardly sloping side walls with increasing height within the bin. A lower housing section is joined directly to the upper housing section with the lower housing section having inwardly sloping side walls with decreasing height with respect to a bottom of the bin. Ventilation panels are mounted in the lower housing section at a predetermined spacing from the side walls and substantially covering the same. The ventilation panels have a plurality of ventilation apertures through which hot gas entering the lower section passes in order to dry out the grain. An inlet for the hot gas is positioned in a side wall of the lower housing section to channel hot gas into spaces between the side walls and the ventilation panels.

In one preferred form of the invention, the lower housing section is substantially or completely below ground level and of concrete, so as to obviate the need for complicated structural support. Furthermore, the inwardly sloping sides of the lower section permit the hot gas to enter the grain to be dried all along the sloping side walls so as to provide a large cross-section to which the grain to be dried is directly exposed. Furthermore, since the upper housing section side walls slope inwardly, as the hot gas rises and contracts, the space to be dried also contracts. Finally, by having a lower housing section with inwardly sloping side walls, access to grain trapped near the bottom of the housing is facilitated by use of the conventional auger technique or by other unloading techniques.

BRIEF DESCRIPTION OF THE DRAWINGS

FIG. 1 is a perspective view of the improved grain drying bin of this invention;

FIG. 2 is a cross-sectional view taken along line II—II of FIG. 1 illustrating the ventilation panels in the lower section of the drying bin;

FIG. 3 is a perspective view of another embodiment of the invention of FIG. 1 in which unloading is facilitated by the provision of an unloading ramp below ground level;

DESCRIPTION OF THE PREFERRED EMBODIMENTS

Figure 5:
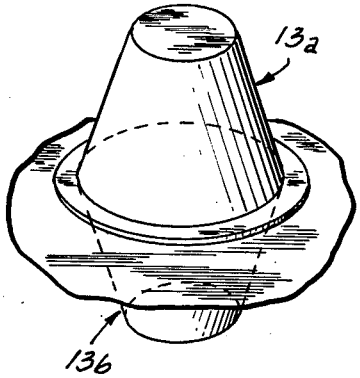
FIGS. 5, 6 and 7 are alternate embodiments of the bin of FIG. 1 in which the shape of the bin is respectively conical, pyramidal with three sides, and pyramidal with a pointed lower section.
Figure 6:
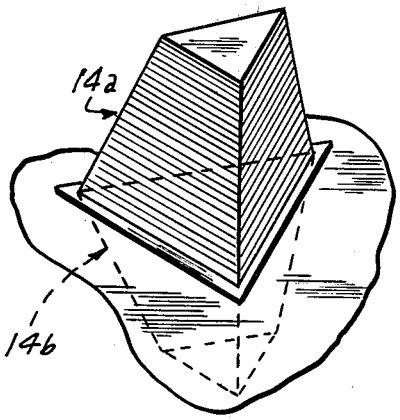
Figure 7:
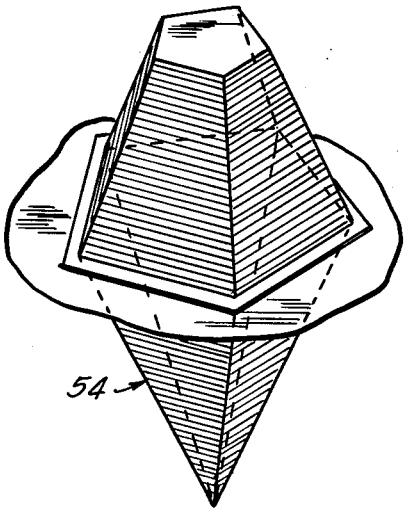

Referring to FIG. 1, an improved grain drying bin 10 is illustrated with a lower housing section 12 mounted below ground level 9. Both an upper housing section 11 and the lower housing section 12 are shaped as four-sided truncated pyramids with the lower pyramid being inverted and joined directly to the upper pyramid. As shown in FIG. 5, the bin may alternately be shaped as the junction of upper and lower truncated cones **13*a* and 13*b* or, as in FIG. 6, upper and lower truncated pyramids having three sides as illustrated at 14*a* and 14*b*. Finally, as shown in FIG. 7, the lower housing section may be a pointed inverted pyramid as illustrated by reference numeral 54**.

Referring again to FIG. 1, the upper housing section has inwardly sloping side walls 15, 16, 17 and 18. The lower section has inwardly sloping side walls 19, 20, 21 and 22. Upper section 11 has a roof portion 23 formed at the upper ends of the side walls 15 through 18 and a trap door 24 in the roof portion 23 is provided as an entranceway for stored grain. An access door 25 in the upper housing section 11 permits access by personnel to the interior of the bin for cleaning the inside of the bin, routine maintenance, etc.

As shown more clearly in FIG. 2, the lower section 12 has four side ventilation panels 26, 27, 28 and 29 spaced a predetermined distance in parallel fashion from the side walls 19 through 22. Support struts 8 secure the ventilation panels in place. A bottom ventilation panel 30 which is substantially horizontal may be supported parallel and spaced from a floor portion 7 of the lower housing section 12.

Ventilation apertures 31 are provided throughout the ventilation panels to permit the entry of hot gas into the dried grain. These apertures 31 are of such dimensions as to prevent the filtering through of large quantities of grain to the spaces between the ventilation panels and the lower section side walls. Alternatively, a screen may be employ in combination with larger apertures to prevent grain seepage through the ventilation apertures.

A hot gas inlet 32, which may be either located on a side wall or in the floor portion 7 of the lower section, is provided to permit the flow of heated gas through all of the side ventilation panels and also up through the floor ventilation panel.

As shown most clearly in FIG. 1, a pipe 33 connects with the hot gas entrance aperture 32. A hot gas generating unit 34 having an internal fan 36 and downstream heater 35 may be provided in known manner for the hot gas generating unit. An inlet 37 permits the entry of air for heating.

To further increase structural rigidity and to prevent sinking of the entire structure, a peripheral side supporting flange 38, 39, 40 and 41 may be provided at the junction of each of the lower and upper side walls.

A system for removing grain from the bin is shown in FIG. 1 in which a truck 47 is backed up adjacent an entrance aperture 43 in the upper housing section 11. As is known in the art, a flexible auger having an internal turn screw 45 is connected through the aperture 43 to internal sections of the auger 44 having an associated turn screw 46. This internal portion of the auger then is moved about the bin to collect the grain therefrom. It will be noted that by providing inwardly sloping lower section side walls, movement of the internal portion of the auger 44 is facilitated since sharp angles do not have to be made at the entrance aperture 43.

In one preferred embodiment of this invention, a universal joint may be utilized at 42 to connect the internal and external portions of the auger.

In another embodiment of the invention shown in FIG. 3, a loading ramp 55 dug below ground level 9 may be employed in place of the auger technique in which case the truck 47 would pull adjacent an exit door 48 in the lower housing section 12 which would then be emptied by gravity flow.

Figure 4:
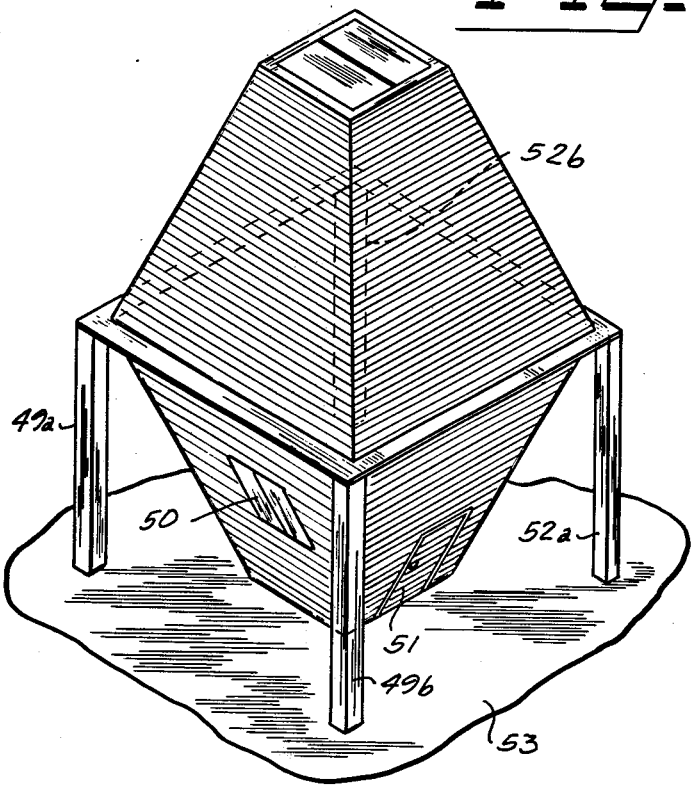
FIG. 4 is another embodiment of the invention of FIG. 1 in which the grain bin is supported above ground.

In FIG. 4 an embodiment of the grain bin of this invention is shown substantially above ground as it may be supported on struts 49*a*, 49*b*, 52*a*, and 52*b*. The struts are supported in the ground 53 at sides of the lower housing section. An entrance door 51 may then be provided in the lower housing section together with an appropriate exit door 50 for unloading of grain.

Although various minor modifications may be suggested by those skilled in the art, it should be understood that I wish to embody within the scope of the patent warranted hereon, all such embodiments as reasonably and properly come within the scope of my contribution to the art.

I claim as my invention:

1. A grain drying bin for rapid drying of stored grains and having a simplified structural supporting system, comprising:

(a) an upper housing section formed of inwardly sloping side walls with increasing height and a roof portion with a grain entry means at a top of the housing section;

(b) a lower housing section having inwardly sloping side walls with decreasing height with respect to a bottom of the bin, side walls of the lower section joining directly with corresponding side walls of the upper section;

(c) ventilation panels mounted in the lower housing portion at a predetermined spacing from the side walls and substantially covering the same, said ventilation panels having a plurality of ventilation apertures;

(d) a hot gas inlet aperture positioned in a wall of the lower housing section to channel hot gas into spaces between the side walls and the ventilation panels;

(e) said lower housing section having a substantial portion mounted below ground level;

(f) an aperture for grain removal means in a side wall of the upper housing; and (g) a universal joint being provided at said grain removal aperture for connection to a grain removal auger.

2. A grain drying bin for rapid drying of stored grains and having a simplified structural supporting system, comprising:

(a) an upper housing section formed of inwardly sloping side walls with increasing height and a roof portion with a grain entry means at a top of the housing section;

(b) a lower housing section having inwardly sloping side walls with decreasing height with respect to a bottom of the bin, side walls of the lower section joining directly with corresponding side walls of the upper section;

(c) ventilation panels mounted in the lower housing portion at a predetermined spacing from the side walls and substantially covering the same, said ventilation panels having a plurality of ventilation apertures;

(d) a hot gas inlet aperture positioned in a wall of the lower housing section to channel hot gas into spaces between the side walls and the ventilation panels;

(e) said lower housing section having a substantial portion mounted below ground level; and (f) an unloading ramp being provided adjacent a lower side wall of the lower housing section below ground level and an unloading port being provided adjacent the unloading ramp.

3. A grain drying bin for rapid drying of stored grains and having a simplified structural supporting system, comprising:

(a) an upper housing section formed of inwardly sloping side walls with increasing height and a roof portion with a grain entry means at a top of the housing section;

(b) a lower housing section having inwardly sloping side walls with decreasing height with respect to a bottom of the bin, side walls of the lower section joining directly with corresponding side walls of the upper section;

(c) ventilation panels mounted in the lower housing portion at a predetermined spacing from the side walls and substantially covering the same, said ventilation panels having a plurality of ventilation apertures;

(d) a hot gas inlet aperture positioned in a wall of the lower housing section to channel hot gas into spaces between the side walls and the ventilation panels;

(e) said lower housing section having a substantial portion mounted below ground level; and (f) a substantially horizontal floor portion being provided at a lower end of the lower housing section and a substantially horizontal ventilation panel having a plurality of ventilation apertures being spaced from the horizontal floor portion.

4. A grain drying bin for rapid drying of stored grains and having a simplified structural supporting system, comprising:

(a) an upper truncated pyramidal shaped housing section having at least three inwardly sloping planar side walls and a horizontal roof portion with a grain entry way;

(b) a lower inverted truncated pyramidal shaped housing section having the same number of planar inwardly sloping side walls of the upper housing section, ends of side walls of the bottom section joining directly to ends of side walls of the upper section, a lower horizontal floor portion also being provided;

(c) ventilation panels mounted in the lower housing section substantially parallel to and at a predetermined spacing from the side walls and floor portion;

(d) a hot gas inlet aperture connected to the lower housing section to channel hot gas into spaces between the side walls and the ventilation panels; and (e) said lower housing section having a substantial portion mounted below ground level.

5. A grain drying bin for rapid drying of stored grains and having a simplified structural supporting system, comprising:

(a) an upper truncated pyramidal shaped housing section having at least three inwardly sloping planar side walls and a horizontal roof portion with a grain entry way;

(b) a lower inverted truncated pyramidal shaped housing section having the same number of planar inwardly sloping side walls as the upper housing section, ends of side walls of the bottom section joining directly to ends of side walls of the upper section, a lower horizontal floor portion also being provided;

(c) ventilation panels mounted in the lower housing section substantially parallel to and at a predetermined spacing from the side walls and floor portion; and (d) a hot gas inlet aperture connected to the lower housing section to channel hot gas into spaces between the side walls and the ventilation panels.

* * * * *